US005678710A

United States Patent [19]

Sheu

[11] Patent Number: 5,678,710

[45] Date of Patent: Oct. 21, 1997

[54] NIPPLE FOR NURSING BOTTLES

[76] Inventor: Miin-Tsang Sheu, No. 156, Cheng Kung Road, Chang Hua City, Taiwan

[21] Appl. No.: 501,470

[22] Filed: Jul. 12, 1995

[51] Int. Cl.[6] ..... A61J 11/02; A61J 11/04

[52] U.S. Cl. ..... 215/11.5; 215/11.1

[58] Field of Search ..... 215/11.1, 11.4, 215/11.5

[56] References Cited

U.S. PATENT DOCUMENTS

| | | | |
|---|---|---|---|
| 380,835 | 4/1888 | Ware | 215/11.5 |
| 1,510,571 | 10/1924 | Ware | 215/11.2 |
| 2,093,730 | 9/1937 | Kurkjian | 215/11.5 |
| 2,365,585 | 12/1944 | Paxman | 215/11.1 |
| 2,744,646 | 5/1956 | Blackstone | 215/11.1 |
| 2,906,088 | 11/1959 | Witz | 215/11.1 X |
| 4,993,568 | 2/1991 | Morifuji et al. | 215/11.1 |

FOREIGN PATENT DOCUMENTS

| | | | |
|---|---|---|---|
| 1432798 | 4/1976 | United Kingdom | 215/11.5 |

*Primary Examiner*—Sue A. Weaver

*Attorney, Agent, or Firm*—Beveridge, DeGrandi, Weilacher & Young LLP

[57] ABSTRACT

A nursing bottle nipple having an outward mounting flange fastened to the neck of a nursing bottle by a bottle cap, a downward projecting tube perpendicularly extended from the outward mounting flange and projecting into the inside of the nursing bottle, a split on the closed bottom end of the downward projecting tube, and a longitudinal air intake hole longitudinally defined within the downward projecting tube and extended to the topmost edge of the outward mounting flange for guiding outside air into the nursing bottle through the split, the split being opened to let outside air enter the nursing bottle when the nipple is sucked by the baby, or closed to stop outside air from entering the nursing bottle and inside liquid from flowing out of the nursing bottle through the air intake hole when the baby stops sucking.

1 Claim, 3 Drawing Sheets

NIPPLE FOR NURSING BOTTLES

BACKGROUND OF THE INVENTION

The present invention relates to nipples for nursing bottles, and relates more particularly to such a nipple which keeps the inside pressure of the nursing bottle in balance with the atmospheric pressure and, which prevents the baby from sucking air.

Nursing bottles are commonly used to feed milk, juice, medicine to babies. A nursing bottle generally comprises a bottle, a bottle cap, and a nipple fastened to the bottle neck of the bottle by the bottle cap for sucking. When sucking, the inside pressure of the nursing bottle will reduce gradually. If outside air is not properly guided into the nursing bottle, the mild or juice becomes unable to be drawn out of the nursing bottle when the inside pressure of the nursing bottle drops to a certain value. Therefore, regular nipples commonly have an air intake hole for guiding outside air into the nursing bottle when sucking. FIG. 1 shows a nipple (1) installed in a nursing bottle. The nipple (1) has an outward mounting flange (12) fastened to the bottle neck of the nursing bottle and fixed in place by the bottle cap (2), defining an accumulating chamber (15). The bottle cap (2) has an inward top flange (21) fastened to the annular mounting groove (14) to hold down the nipple (1), and a top rib (22) stopped above the outward flange (12). The nipple (1) further comprises an air intake hole (11) through the outward mounting flange (12) and an outside recess (13) for guiding outside air into the nursing bottle through the air intake hole (11). When the baby sucks the nipple, outside air (A) is drawn from the outside recess (13) through gap (1A) and gap (2A) into the air intake hole (11) and then into the nursing bottle to balance the inside pressure with the atmospheric pressure. This structure of nipple has drawbacks. The drawbacks of this structure of nipple is outlined hereinafter.

1). Because the width of the gap (1A) and the height of the rib (22) are defined within 1 mm, the precision requirement of the molding of the nipple (1) is critical. More particularly, the width of the gap 1A is to match the diameter of the inward top flange (21) of the bottle cap (2) and the diameter of the annular mounting groove (14), the nipple molding tool is complicated to manufacture.

2). The nipple (1) is molded from flexible rubber and tends to be deformed by pressure. When the bottle cap (2) is not properly fastened to the nursing bottle, the outward mounting flange (12) of the nipple (1) will be twisted, causing the gap (2A) reduced or disappeared (the top side of the outward mounting flange (12) closely attached to the bottom side of the bottle cap (2)). When the gap (2A) is reduced or disappeared, the function of the outside recess (13) becomes restricted.

3). The nipple (1) cannot fit all nursing bottles of different sizes because of the limitation of the fixed sizes of the inward top flange (21) of the bottle cap (2), the annular mounting groove (14), and the rib (22).

4). When outside air (A) enters the nipple (1) it comes together in the accumulating chamber (15), therefore the baby will take air into the mouth when sucks the milk or juice from the nipple (1).

SUMMARY OF THE INVENTION

The present invention has been accomplished to provide a nipple which eliminates the aforesaid drawbacks. According to one aspect of the present invention, the nipple comprises a downward projecting tube projecting into the inside of the nursing bottle and having a closed bottom end with a split, and a longitudinal air intake hole defined within the downward projecting tube and extended to the top side of the outward mounting flange of the nipple for guiding outside air into the inside of the nursing bottle to balance the inside pressure of the nursing bottle with the atmospheric pressure. According to another aspect of the present invention, the downward projecting tube projects into the inside of the nursing bottle to prevent intake air from coming together in the accumulating chamber of the nipple, therefore the baby does not take air into the mouth when sucks the milk or juice from the nipple. According to still another aspect of the present invention, the downward projecting tube projects into the inside of the nursing bottle and does not touch the bottle cap, therefore the installation of the bottle cap does not twist the downward projecting tube, and the function of the downward projecting tube is constantly maintained in effect. According to still another aspect of the present invention, when the nipple is installed in a nursing bottle of different size, the downward projecting tube is still maintained effective, therefore the nipple can fit any of a variety of nursing bottles.

BRIEF DESCRIPTION OF THE DRAWINGS

FIG. 2A is a front elevational view of a nipple according to the present invention;

FIG. 2B is an enlarged view of the end of the projecting tube of the nipple shown in FIG. 2A when closed;

FIG. 4A is an enlarged view of the end of the projecting tube of the nipple shown in FIG. 4 when opened.

DETAILED DESCRIPTION OF THE PREFERRED EMBODIMENT

Figure 1:
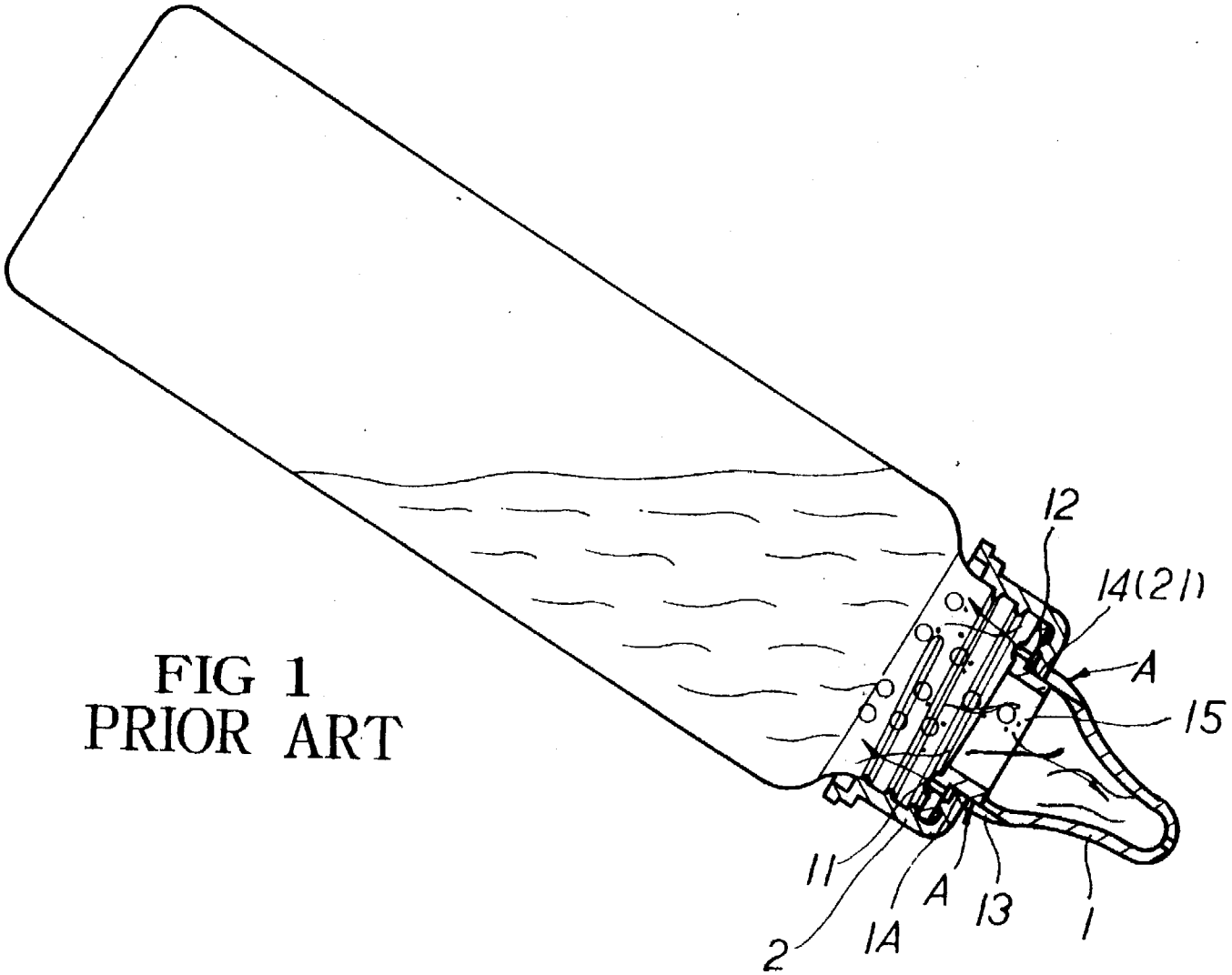
FIG 1 PRIOR ART
FIG. 1 is a sectional view of a nipple installed in a nursing bottle according to the prior art.
Figure 2:
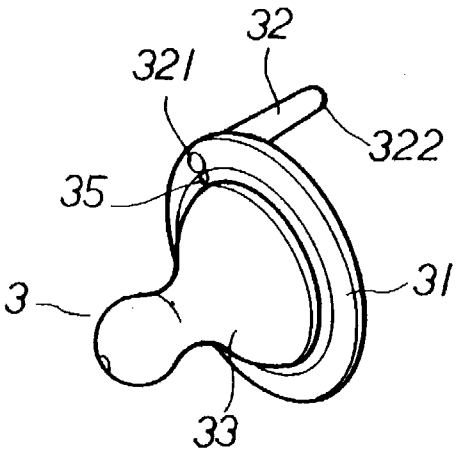
FIG. 2 is a rear elevational view of a nipple according to the present invention.
Figure 2:
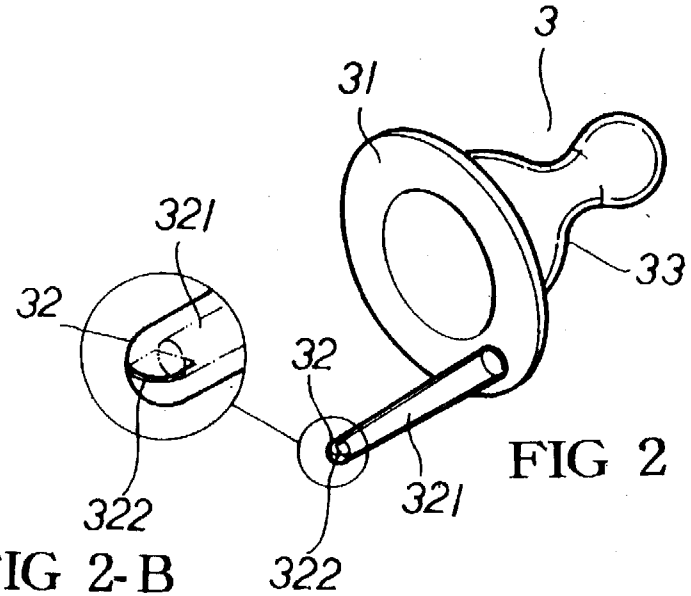
Figure 3:
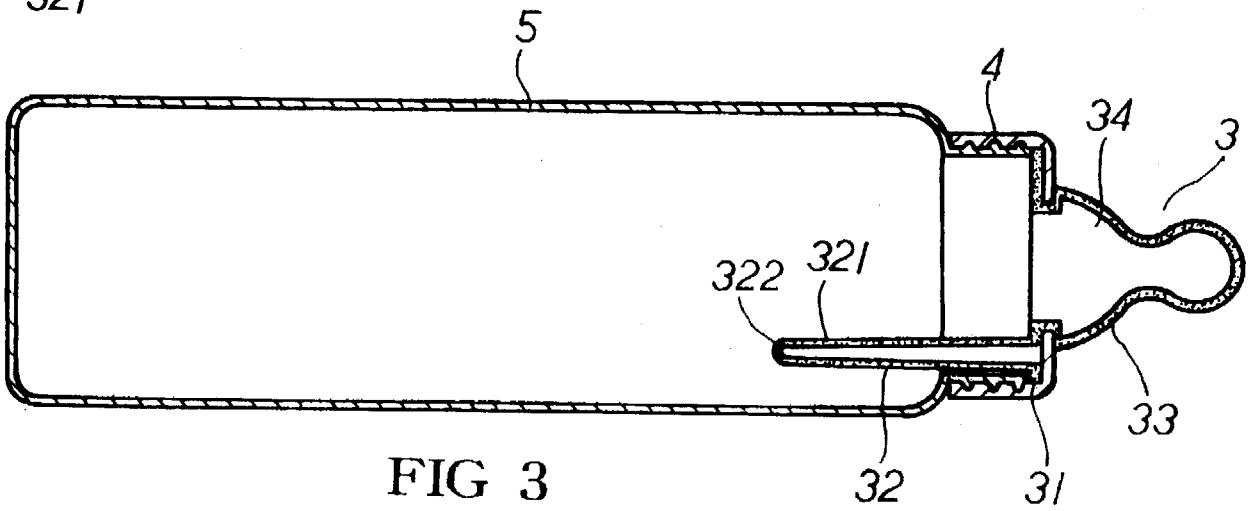
FIG. 3 is a longitudinal view in section showing the nipple installed.

Referring to FIGS. 2, 2A, 2B, and 3, the nipple 3 comprises a nipple body 33, an outward mounting flange 31 outwardly extended from the nipple body 33 at the bottom, an accumulating chamber 34 defined within the nipple body 33, a downward projecting tube 32 perpendicularly extended from the bottom side of the outward mounting flange 31, an annular mounting groove 35 around the border area between the nipple body 33 and the outward mounting flange 31, and a longitudinal air intake hole 321 longitudinally defined within the downward projecting tube 32 and extended to the top side of the outward mounting flange 31. The downward projecting tube 32 has a split 322 on the closed bottom end thereof in communication with the air intake hole 321. When the nipple 3 is installed in the neck of the nursing bottle 5 and fixed in place by the bottle cap 4, the downward projecting tube 32 projects into the inside of the nursing bottle 5. When the nipple 3 is not sucked, the inside pressure of the nursing bottle 5 is approximately equal to the atmospheric pressure, therefore the split 322 is closed to prohibit outside air from entering the nursing bottle 5 through the air intake hole 321, and the milk or juice is stopped from flowing out of the nipple 3 through the air intake hole 321.

Figure 4:
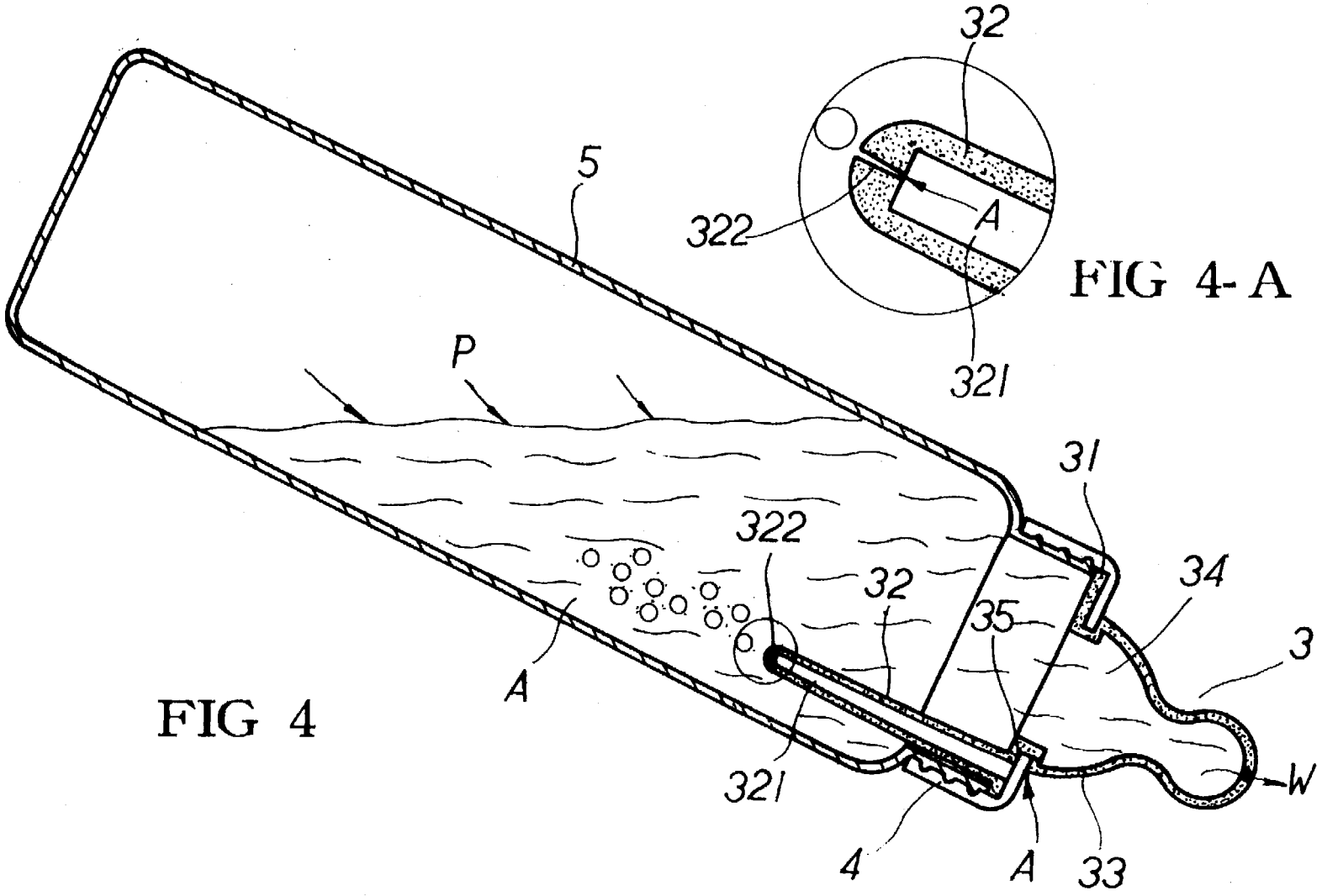
FIG. 4 is an applied view showing the nipple sucked.

Referring to FIGS. 4 and 4A, when the milk (juice) W is sucked out of the nipple 3 by the baby, the inside pressure P of the nursing bottle 5 is reduced gradually. When the atmospheric pressure surpasses the inside pressure P of the nursing bottle 5, the split 322 is forced open to let outside air A enter the nursing bottle 5 through the air intake hole 321 to balance the pressure. Because the downward projecting tube 32 projects into the inside of the nursing bottle 5, the intake current of air A does not come together in the accumulating chamber 34. Therefore, the baby does not take air into the mouth when sucks the milk or juice from the nipple 3.

While only one embodiment of the present invention has been shown and described, it will be understood that various modifications and changes could be made without departing from the spirit and scope of the invention disclosed.

I claim:

1. A nursing bottle nipple comprising a flexible body including an accumulator chamber, an outward mounting flange with an upper and lower surface incorporating an outward mounting groove adapted to receive a nursing bottle cap, a longitudinal air intake tube formed from a downwardly projecting tube extending perpendicularly from the lower surface of said outward mounting flange and a distance sufficient to direct air away from the accumulator chamber, said intake tube defining an air intake hole formed along the upper surface in said outward mounting flange and groove which extends from said downwardly projecting tube through to the topmost edge of the upper surface of the said outward mounting flange and groove, said downwardly projecting tube having a split openable bottom end in air communication with said air intake hole, said split bottom end being opened to permit entry of ambient air when subject to negative pressure during feeding and closed to prevent fluid flow therethrough when pressure is balanced where said nursing bottle nipple hoes not twist to reduce the air intake hole and provides for uninterrupted air flow through the intake hole.

* * * * *